US006782836B1

(12) United States Patent
Hales

(10) Patent No.: US 6,782,836 B1
(45) Date of Patent: Aug. 31, 2004

(54) EMBROIDERY MACHINE WITH A CAP BILL SUPPORT DEVICE

(76) Inventor: Allan Hales, P.O. Box 1244, 5 W. Hazel Dr., Salem, UT (US) 84653

( * ) Notice: Subject to any disclaimer, the term of this patent is extended or adjusted under 35 U.S.C. 154(b) by 0 days.

(21) Appl. No.: 10/620,502

(22) Filed: Jul. 15, 2003

(51) Int. Cl.[7] ..... D05C 9/04
(52) U.S. Cl. ..... 112/103; 112/475.11
(58) Field of Search ..... 24/455, 457, 458, 24/499, 513, 530; 112/103, 470.14, 475.11, 470.06, 470.09; 38/102.2, 102.91

(56) References Cited

U.S. PATENT DOCUMENTS

| | | | | | |
|---|---|---|---|---|---|
| 4,598,488 | A | * | 7/1986 | Inteso | 38/102.3 |
| 4,665,844 | A | * | 5/1987 | Shibata | 112/103 |
| 4,831,753 | A | | 5/1989 | Inteso | 38/102.3 |
| 4,998,964 | A | | 3/1991 | Golia | 112/121.12 |
| 5,415,116 | A | | 5/1995 | Nishio | 112/103 |
| 5,507,241 | A | | 4/1996 | Evans | 112/470.18 |
| 5,553,560 | A | | 9/1996 | Tajima et al. | 112/103 |
| 5,598,797 | A | | 2/1997 | Patterson | 112/103 |
| 5,649,496 | A | | 7/1997 | Morita et al. | 112/103 |
| 5,701,831 | A | | 12/1997 | Morita | 112/103 |
| 5,832,853 | A | | 11/1998 | Pokrishevsky et al. | 112/475.11 |
| 5,862,765 | A | | 1/1999 | Grundl | 112/103 |
| 5,911,183 | A | * | 6/1999 | Goto | 112/103 |
| 5,937,774 | A | * | 8/1999 | Hayashi | 112/103 |
| 6,019,053 | A | | 2/2000 | Kawaguchi | 112/103 |
| 6,189,468 | B1 | | 2/2001 | French | 112/103 |
| 6,463,867 | B2 | * | 10/2002 | Kato | 112/103 |

* cited by examiner

*Primary Examiner*—Ismael Izaguirre

(57) ABSTRACT

Embroidery machines have previously not been well adapted to embroider billed caps such as baseball caps. A bill hook is secured or hooked on the distal end of the bill. The hook is supported by a base support, which is mounted to the hat hoop base frame. The bill is flexed away from the head portion of the cap, thereby providing room for the embroidery machine to access the area immediate adjacent to the bill that is embroidered. By flexing the bill away from the head portion of the cap and attaching it to the hat hoop base frame, which moves with the cap as it is moved in the embroidery machine, the bill is much less likely to become jarred lose from the hat hoop base frame during the embroidery process. This reduces registration errors and with it the scrap rate of caps.

18 Claims, 7 Drawing Sheets

EMBROIDERY MACHINE WITH A CAP BILL SUPPORT DEVICE

FIELD OF THE INVENTION

The present invention generally relates to embroidery equipment. More specifically, the present invention relates to devices used in the embroidery of headgear and other products that have a protrusion such as a bill.

BACKGROUND OF THE INVENTION

As technology advances, people desire more elaborate and far-reaching methods of identification as individuals or to identify with a particular group. Companies desiring to create employee unity or brand awareness provide their logo on clothing. People identify with sports teams, schools or other institutions as a means of support or identification with that group. In each of these, the use of embroidery is much superior in durability and long-term appearance than silk screening or other printing processes. As such, the embroidery of clothing and other cloth materials is a thriving industry.

One such embroidered product that stands out is the cap. A billed cap or "baseball" cap is commonly worn by everyone from athletes to fans and even someone that just wants to keep the sun out of their eyes while mowing the lawn. A logo on a cap is extremely valuable regarding visibility of that logo in that it is the closest to eye level of any worn item as the wearer is viewed by someone else. The problem with embroidery on the front of the billed cap is the bill. This protrusion extends several inches beyond the front of the cap and immediately adjacent to the area that is embroidered. As such, the bill is commonly in the way of the embroidery machine. If the cap is bumped during the embroidery process the registration of one color thread relative to the next color thread used would be lost and the cap would be scrapped. This increased scrap rate greatly increases the cost of production. Few attempts have been made to correct this problem. One attempt has been by use of a rubbing plate that is a stationary plate mounted on the machine. As the cap is rotated and moved in the embroidery machine to embroider the logo or other art, this bill is also rotated side-to-side and front to back. The rubbing plate latterly rubs against the bill of the cap as it moves to keep it clear from the area that is being embroidered. As one can imagine, this "beating " of the bill against the rubbing plate only increases the chances of knocking the cap loose, thus losing registration and scrapping the item.

SUMMARY OF THE INVENTION

In one aspect, the invention features an embroidery machine with a cap bill support device, the machine including a hat hoop base frame. The device includes bill hook capable of physical attachment to the cap bill and a base support secured to the hat hoop base frame. The base frame receives the bill hook, thereby offering removable support of the cap bill when positioned adjacent to the hat hoop base frame.

The machine may also include a hook that is pivotally mounted to the base support. The hook may include a substantially "L" shaped arm including a foot, thereby enabling attachment to the cap bill. The hook may also include a clamp that is releaseably secured to the cap bill. The arm of the hook is received by the base support and optimally received by a lip hook on the base support. The support device may comprise a substantially flat plate including at least one mounting hole, thereby enabling mounting of the substantially flat plate to a peripheral flange on the hat hoop base frame. Alternatively, the arm may be received by a lip hook on a visor bracket, which is mounted to the hat hoop base frame.

In another aspect, the invention includes a method of providing a method of supporting a cap bill to facilitate the embroidery of a cap and including the steps of providing a device as previously described and positioning a cap in the embroidery device adjacent to the hat hoop base frame. The user displaces a portion of the cap bill toward the base support and attaches the bill hook to the cap bill with the bill hook supported by the base support. This attachment maintains the cap bill in a displaced orientation to facilitate embroidery of the cap.

BRIEF DESCRIPTION OF THE DRAWINGS

The foregoing and other objects of this invention, the various features thereof, as well as the invention itself, may be more fully understood from the following description, when read together with the accompanying drawings, described.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

Figure 1:
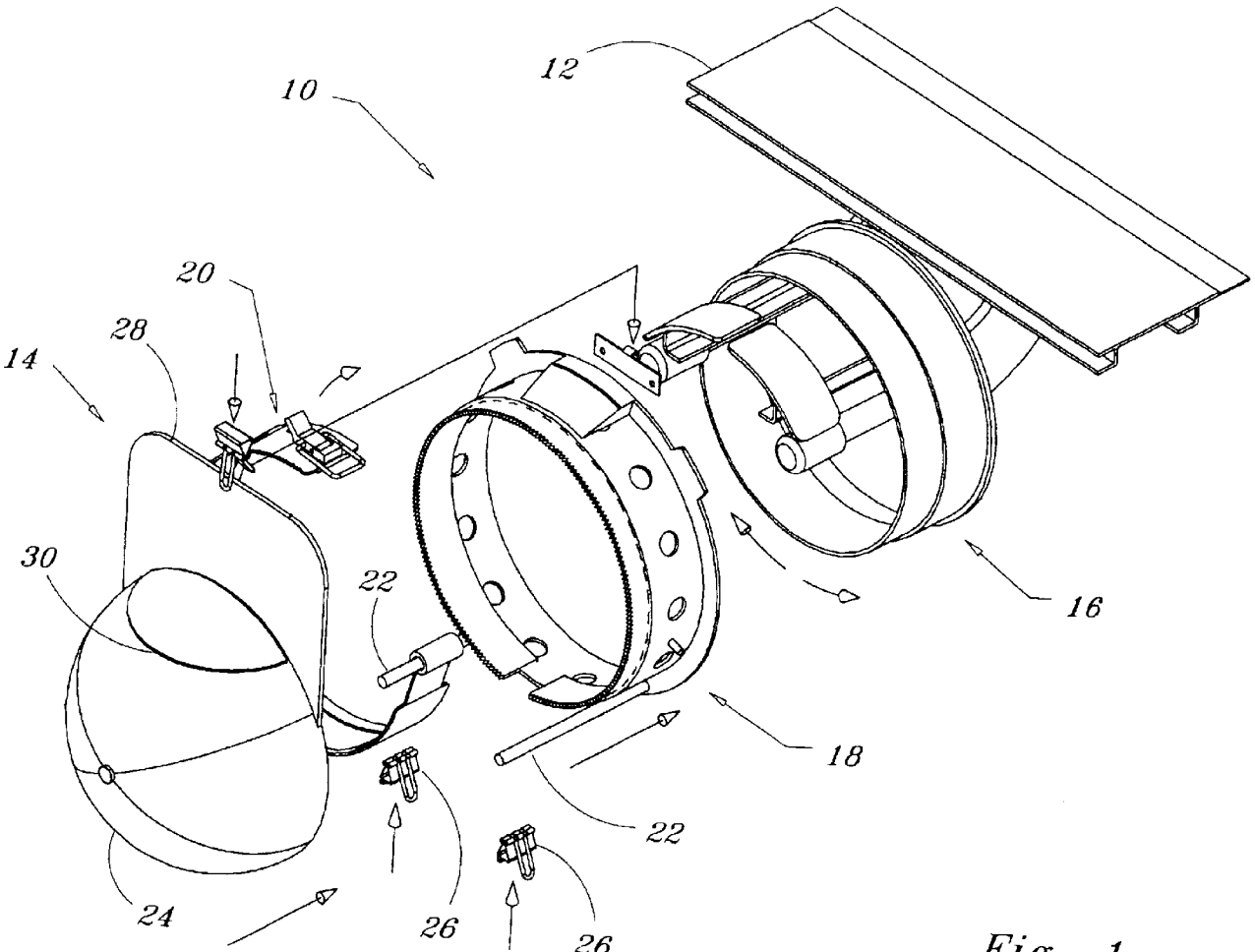
FIG. 1 is an isometric exploded view of a portion of an embroidery machine incorporating a bill support device, the device produced in accordance with the present invention.

The present invention is an embroidery machine with a cap bill support device. Some of the components of the machine 10, as they relate to the novelty of the invention, are shown in FIG. 1. The rack support rail 12 is a longitudinal rail that offers a means of support for one, or usually multiple heads (not shown) that perform the actual sewing of the embroidery process. In addition, for each bead, there is a mechanism to hold or secure and move the article being embroidered. For caps 14 and other items of similar shape, a hat rack 16 is the base of that holding mechanism. The hat rack 16 supports the cap 14 and moves relative to the rail 12 to enable a design to be embroidered onto the article. A key element regarding the novelty of this invention is the hat hoop base frame 18. This item directly holds the cap 14 and is secured thereon by the lid frame 20. A pair of base frame shafts 22 extend from the hat hoop base frame 18 and provide support for the lid frame 20 as well as help support the back side of the hat portion 24 of the cap 14. A pair of clips 26 are typically used to assist in holding the cap 14 secured to the hat hoop base frame 18 by way of clamping the back of the hat 24 to the base frame shafts 22.

When the cap 14 is fully mounted onto the hat hoop base frame 18, it is critically important that the cap 14 does not move relative to the hat hoop base frame 18 as the hat rack 16 rotates and moves the assembly of the hat hoop base frame 18 and cap 14. This movement is necessary as this provides the ability for the logo or design to be applied by the head, which is substantially stationary relative to the rack support rail 12. If there is any slippage of the cap 14 on the hat hoop base frame 18, registration will be compromised and the embroidered design will be flawed. The part must then be scrapped, thus adding greatly to the cost of the embroidery process. To complicate matters, the cap 14 includes a bill 28 that extends away from the hat portion 24, but is immediately adjacent to the embroidery area 30. As such, during the embroidery process, this cantilevered structure of the bill 28 is whipping back and forth, potentially coming into contact with the head or other structure of the machine 10. One severe hit and the cap 14 can be dislodged enough to damage the embroidery in process.

To overcome this problem the applicant has devised a convenient mechanism that hooks the bill 28 back away from the embroidery area 30, to make room for the head to work and secures the bill 28 to a portion of the hat hoop base frame 18. This moves with the cap 14 as it moves during the embroidery process, greatly reducing the possibility of inadvertent movement of the cap 14.

Figure 2:
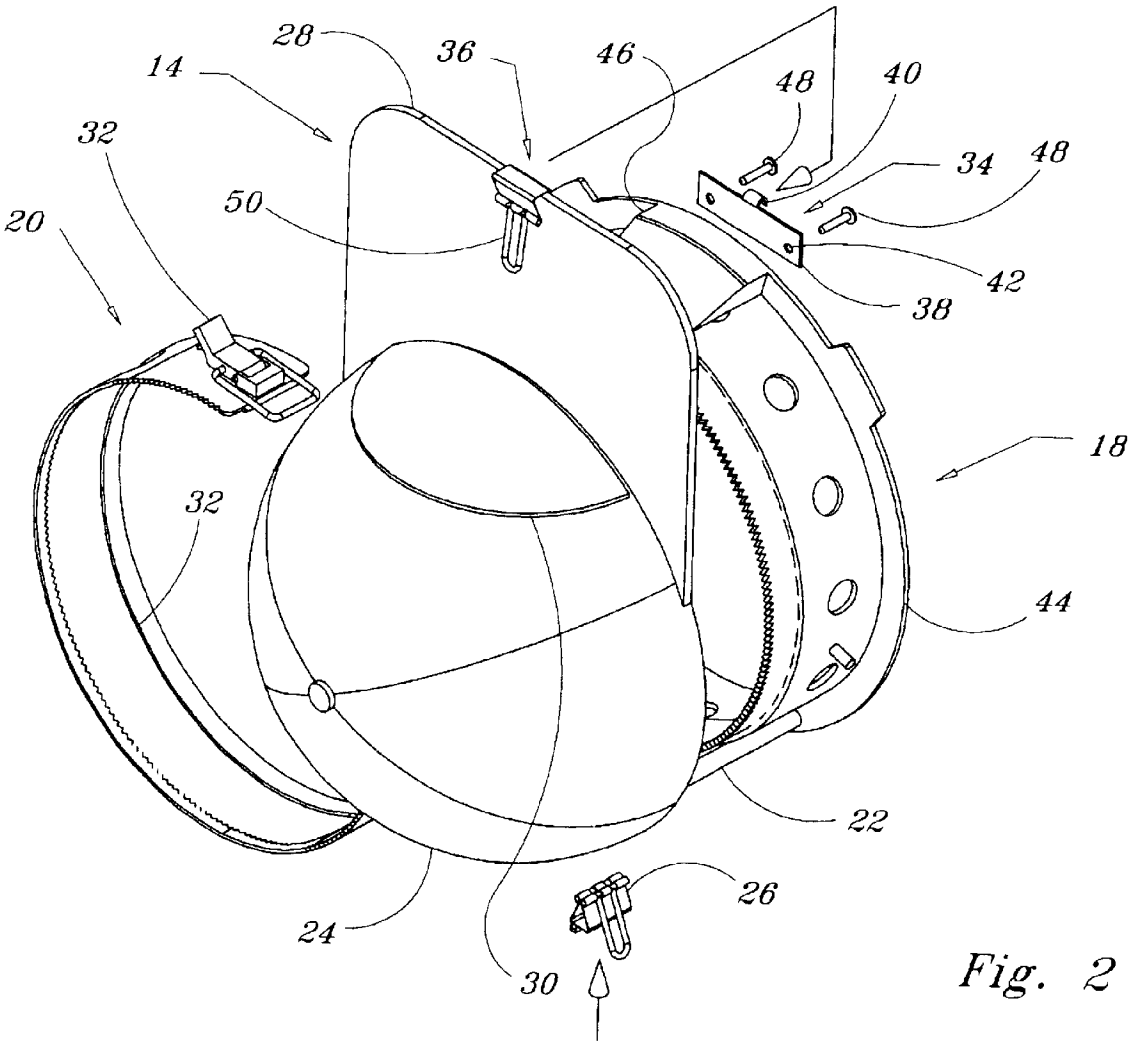
FIG. 2 is an isometric exploded view of a hat hoop base frame and a lid frame of an embroidery machine incorporating a bill support device, the device produced in accordance with the present invention.

What is shown in FIG. 2 is an enlarged view of the hat hoop base frame 18, cap 14 and lid frame 20. The assembly of the cap 14 on the hat hoop base frame 18 includes the bill 28 being received by the bill slot 32 in the lid frame 20. The lid frame 20 then rotates over the cap 14 and is clamped into place on the hat hoop base frame 18 by use of the pinch lock 32. The novelty of the assembly is due to the base support 34 and the bill hook 36. In this form of the invention the base support is comprised of a substantially flat plate 38 including a lip hook 40. Holes 42 are positioned in the flat plate 38 to allow the base support 34 to be mounted to the hat hoop base frame 18. As shown here, the optimal mounting is to a peripheral flange 44 on the hat hoop base frame 18. On the backside of the flange 44 is the visor bracket 46, which is typically mounted to the flange 44 by a pair of screws 48. These same screws 48 can be used to secure the base support 34 and the visor bracket 46 to the flange 44 of the hat hoop base frame 18.

The bill hook 36 is shown here to be in the form of a clip 26 as is also used to secure the hat portion to the base frame shafts 22. The clamping portion of the clamp acts as a foot to grab the distal end of the bill 28. The other critical aspect of the bill hook 36 is the arm, in this case that being one of the clamp arms 50. The use of these components is better illustrated in FIG. 3.

Figure 3:
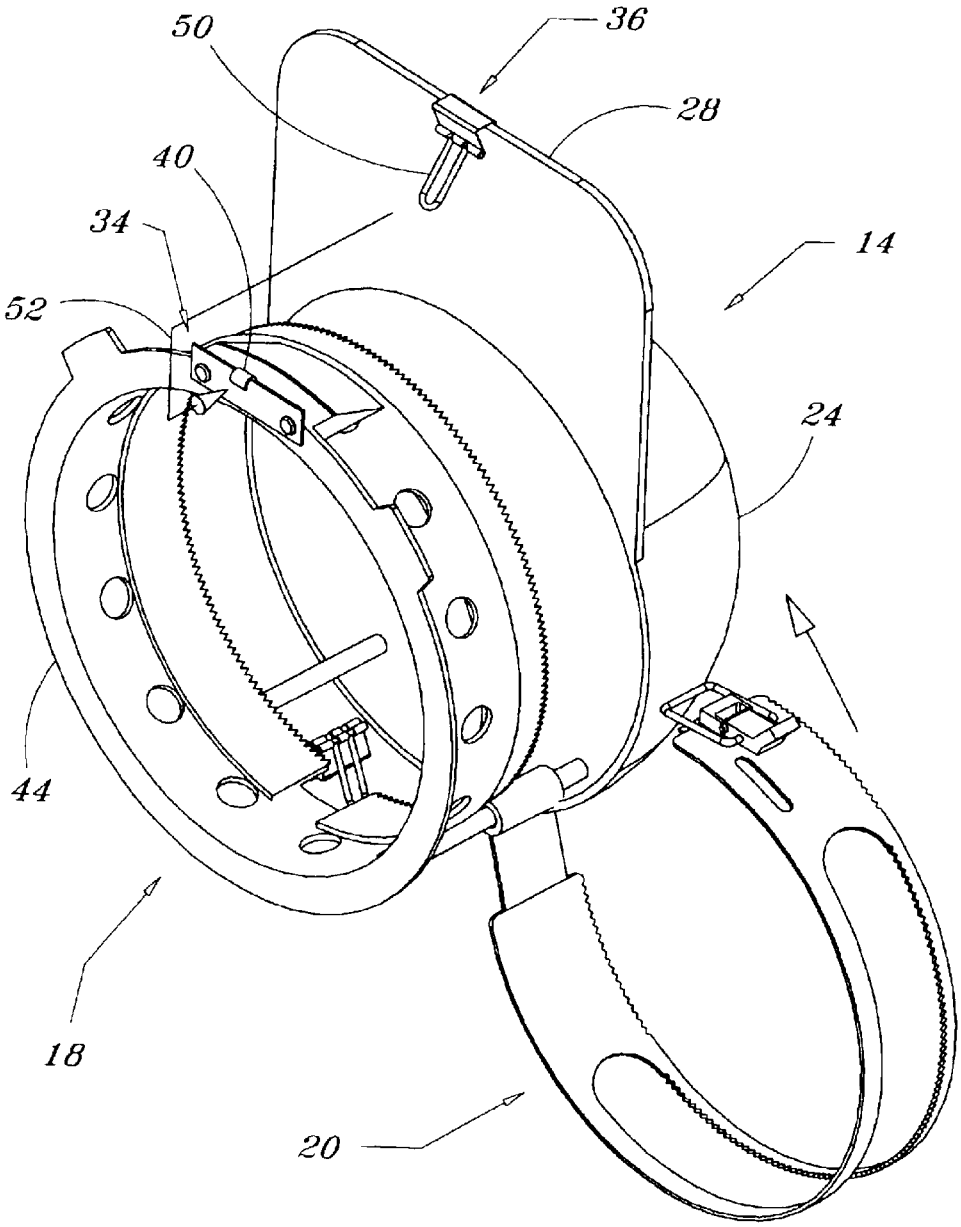
FIG. 3 is an alternative view of the exploded view as shown in FIG. 2, showing a bill support device, the device produced in accordance with the present invention.

FIG. 3 shows the same elements of FIG. 2 only from the opposite direction. The base support 34 is fastened to the hat hoop base frame 18 by way of the peripheral flange 44. The lip hook 40 extends away from the cap 14. As the cap 14 is received on the hat hoop base frame 18 and fastened down by the lid frame 20, the clamp arm 50 can be received by the lip hook 40. This is shown by the arrow 52. In order for this to be accomplished, the cap bill 28 must be bent toward the flange 44. This moves the cap bill 28 away from the hat portion 24, which is to be embroidered.

Figure 4:
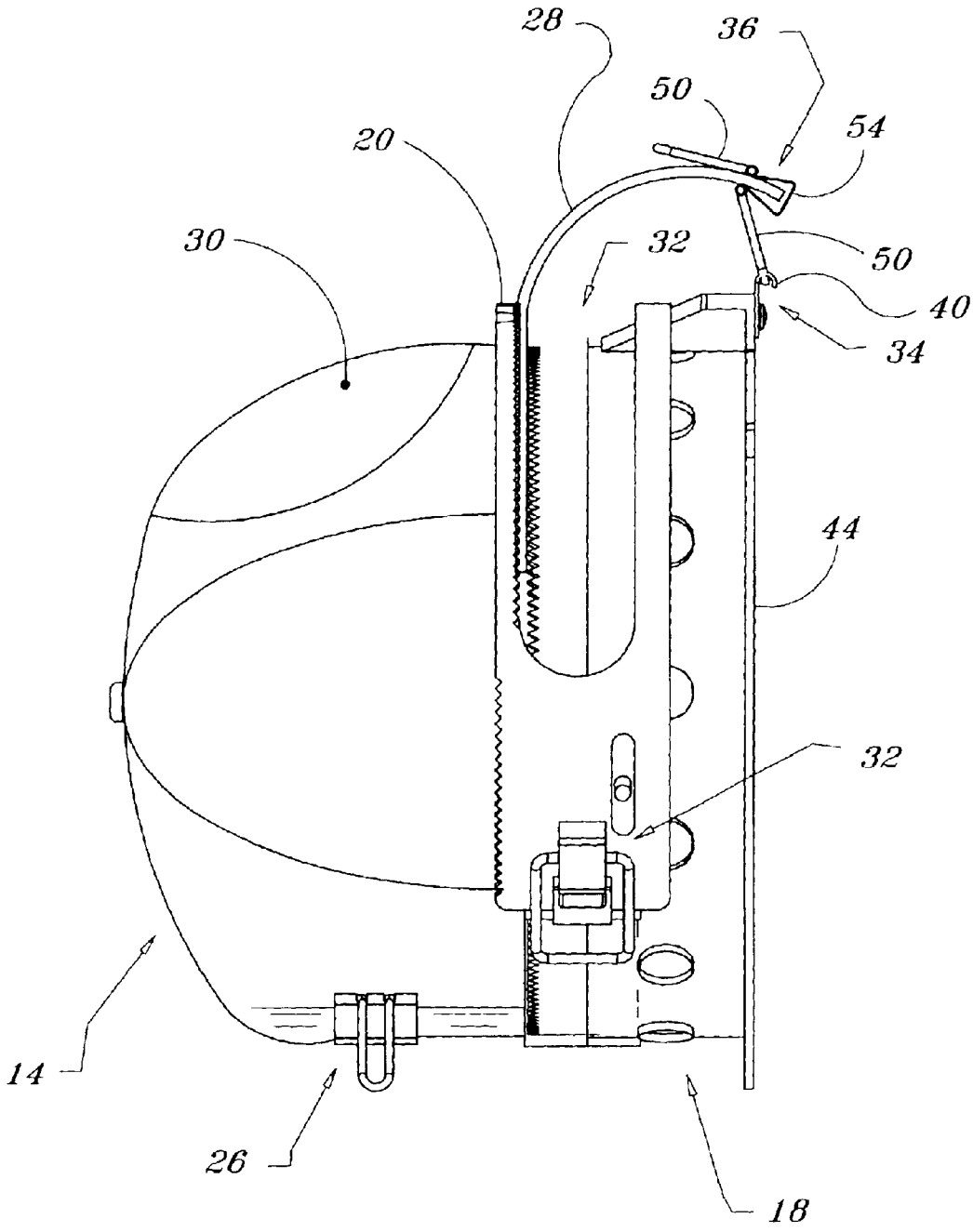
FIG. 4 is a side view of a hat hoop base frame and lid frame with a cap positioned therein with the bill of the cap being secured by a bill support device, the device produced in accordance with the present invention.

A side view of the cap 14 assembled into the hat hoop base frame 18 is shown in FIG. 4. The cap 14 sits over a portion of the hat hoop base frame 18 and the lid frame 20 is clamped into place by the pinch lock 32, the bill 28 extending through the bill slot 32. The bill 28 is secured by the clamp 54 of the bill hook 36 and the arm of the bill book 36, in the form of one of the clamp arms 50. The lower arm 50 is received by the lip hook 40 of the base support 34. This flexes the bill 28 toward the flange 44 and away from the embroidery area 30 of the cap 14.

Figure 5:
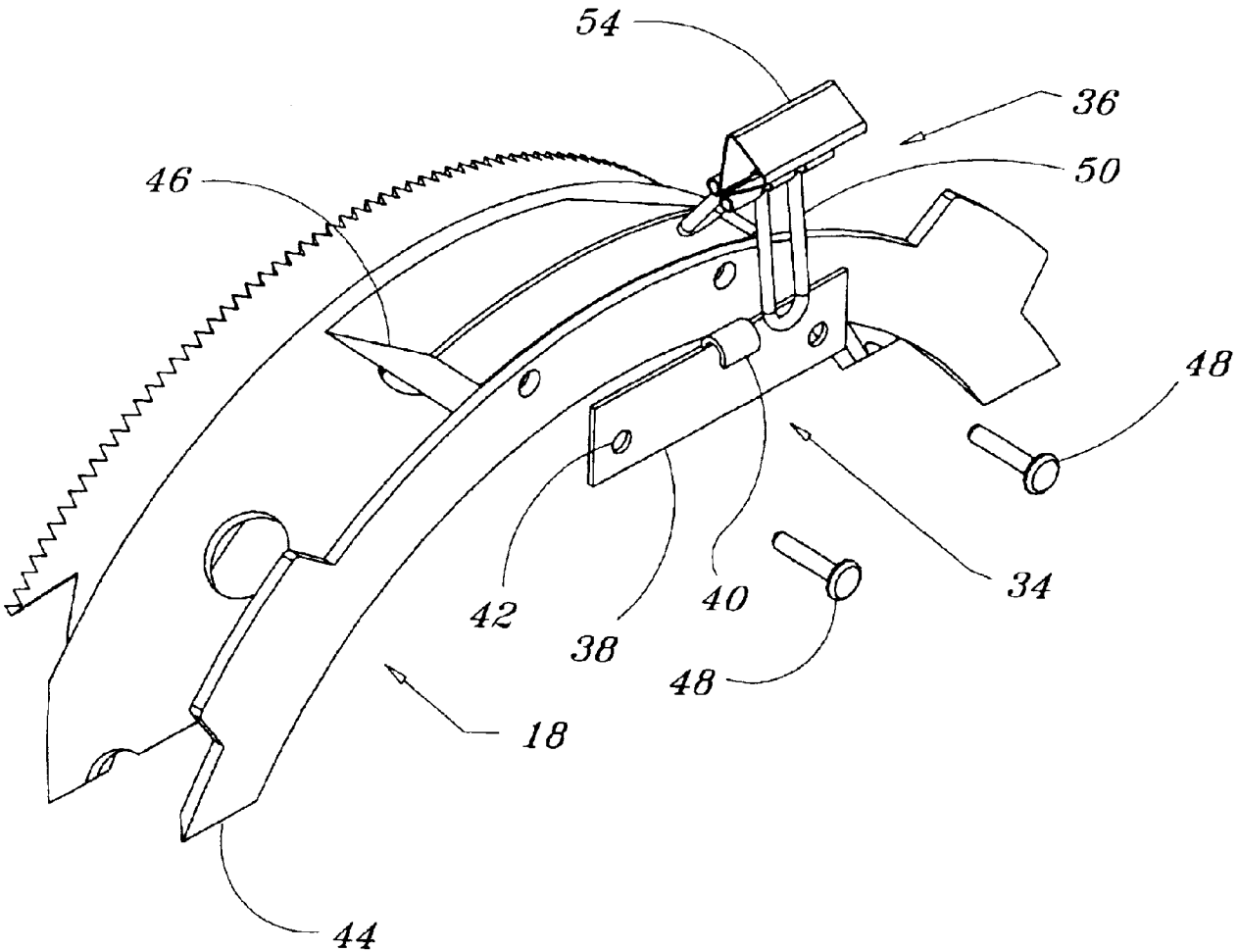
FIG. 5 is a cut away of an upper portion of a hat hoop base frame with a bill support device in an exploded form, the device produced in accordance with the present invention.
Figure 6:
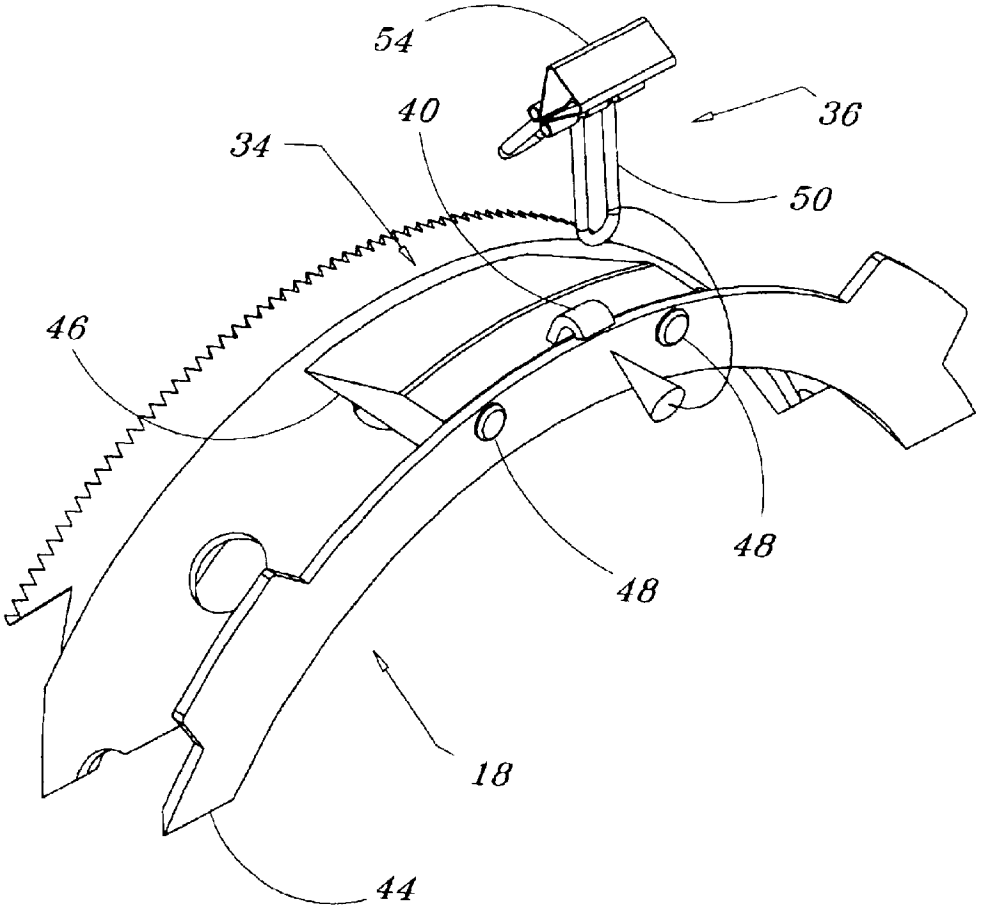
FIG. 6 is a cut away of an upper portion of a hat hoop base frame with a bill support device shown as an element of the visor bracket, the device produced in accordance with a form of the present invention.
Figure 7:
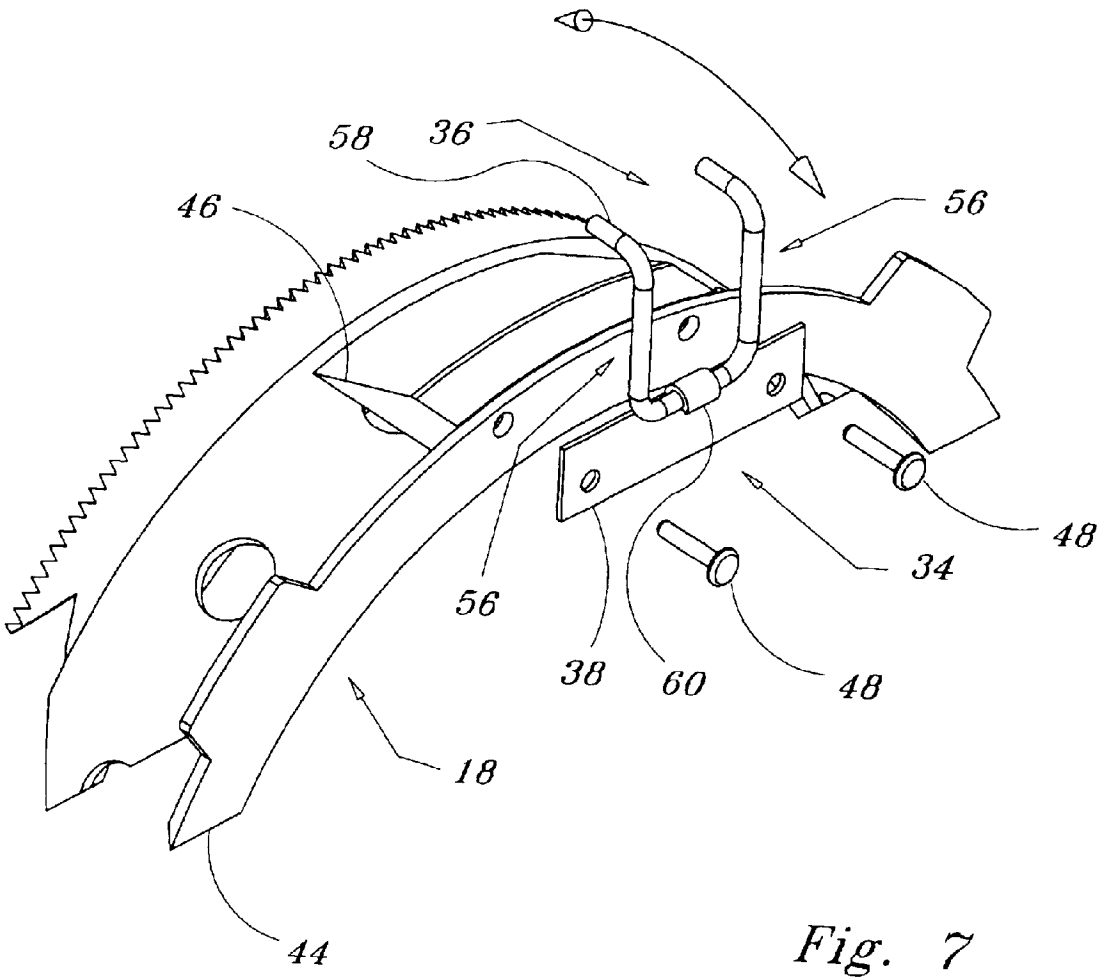
FIG. 7 is a cut away of an upper portion of a hat hoop base frame with a bill support device in an exploded form with an alternative bill hook, the device produced in accordance with a form of the present invention.

Specifics of the area of the hat hoop base frame 18 near the base support 34 in a variety of forms is shown in FIG. 5; FIG. 6 & FIG. 7. In FIG. 5, the elements as previously disclosed are shown in an exploded isometric view. The base support 34 is comprised of a substantially flat portion 38 and a lip hook 40. Holes 42 allow the screws 48 to be fastened through the flange 44 while also supporting the visor bracket 46. The bill hook 36 is comprised of a clamp 54 with clamp arms 50, one of which is received by the lip hook 40 to hold a cap bill in place.

A variation is shown in FIG. 6 in which the base support 34 is comprised of a modified visor bracket 46. The modification includes the placement of a lip hook 40 directly on the visor support 46, the hook 40 preferably located near the flange 44 of the hat hoop base frame 18 when assembled thereon. The bill hook 36 can take the similar form of the clamp 54 as shown here. As before, the screws 48 are used to fasten the base support 34 to the hat hoop base frame 18 and in this case this also includes the visor bracket 46 in that they are the same part. Another alternative to this, which is not shown is a modification of the flange 44 to include a lip hook 40 as part thereof. By fastening the base support 34 to the flange 44, it is understood that another variation would be in providing the lip hook as part of the flange 44, thereby making the flange 44 directly part of the base support 34.

Another variation is shown in FIG. 7 wherein the bill hook 36 is comprised of a substantially "L" shaped arm 56 including a foot 58 enabling attachment to the cap bill. This arm 56 can be a single arm or a double arm, as shown here, and it can be pivotally mounted to the base support 34 by way of a pivot joint 60. Alternatively this pivot joint 60 can be a lip hook as previously disclosed, and the arm 56 can be releaseably mounted to the base support 34, as previously described with the clamp. The specific structure of the leg(s) 56 can vary but a simple hook of the foot 58 can be adequate to hook around the cap bill and hold it into position as previously disclosed.

What is claimed is:

1. An embroidery machine with a cap bill support device, the machine including a hat hoop base frame, the device comprising:

a bill hook capable of physical attachment to said cap bill; and a base support including a lip hook, the base support secured to said hat hoop base frame, said base frame receiving said bill hook, thereby offering removable support of said cap bill when positioned adjacent to said hat hoop base frame.

2. A device as in claim 1, wherein said bill hook is pivotally mounted to said base support.

3. A device as in claim 1, wherein said bill hook includes a substantially "L" shaped arm including a foot enabling attachment to said cap bill.

4. A device as in claim 1, wherein said bill hook includes a clamp that is releaseably secured to said cap bill.

5. A device as in claim 1, wherein said bill hook further includes an arm that is received by said lip hook.

6. A device as in claim 1, wherein said base support is comprised of substantially flat plate.

7. A device as in claim 6, wherein said substantially flat plate includes at least one mounting hole, thereby enabling mounting of said substantially flat plate to a peripheral flange on said hat hoop base frame.

8. A device as in claim 6, wherein said substantially flat plate is mounted adjacent to a visor bracket mounted on said hat hoop base frame.

9. A device as in claim 1, further comprising an arm being received by said lip hook on a visor bracket, the visor bracket being mounted to said hat hoop base frame.

10. An embroidery machine of the type that is used in the embroidery of products that have a cap bill, the machine also including a hat hoop base frame and a hat rack, the improvement comprising:

a bill hook capable of physical attachment to said cap bill; and a base support including a lip hook, the base support secured to said hat hoop base frame, said base frame receiving said bill hook, thereby offering removable support of said cap bill when positioned adjacent to said hat hoop base frame.

11. A machine as in claim 10, wherein said bill hook is pivotally mounted to said base support.

12. A machine as in claim 10, wherein said bill hook includes a substantially "L" shaped arm including a foot enabling attachment to said cap bill.

13. A machine as in claim 10, wherein said bill hook includes a clamp that is releaseably secured to said cap bill.

14. A machine as in claim 10, wherein said bill hook further includes an arm that is received by said lip hook.

15. A machine as in claim 10, wherein said base support is comprised of a substantially flat plate.

16. A machine as in claim 15, wherein said substantially flat plate includes at least one mounting hole, thereby enabling mounting of said substantially flat plate to a peripheral flange on said hat hoop base frame.

17. A machine as in claim 15, wherein said substantially flat plate is mounted adjacent to a visor bracket mounted on said hat hoop base frame.

18. For use with an embroidery machine including a bill hook capable of physical attachment to a cap bill and a base support including a lip hook, the base support secured to a hat hoop base frame, an embroidery method comprising the steps of:

positioning a cap in said embroidery device adjacent to said hat hoop base frame;

displacing a portion of said cap bill toward said base support;

attaching said bill hook to said cap bill with said bill hook supported by said lip hook, thus maintaining said cap bill in a displaced orientation.

* * * * *